US005423262A

United States Patent [19]

Pettersson et al.

[11] Patent Number: 5,423,262

[45] Date of Patent: Jun. 13, 1995

[54] MAGNETIC PROXIMITY FUSE

[75] Inventors: Elizabeth Pettersson; Ragnar Forshufvud, both of Karlskoga, Sweden

[73] Assignee: Bofors AB, Karlskoga, Sweden

[21] Appl. No.: 145,178

[22] Filed: Nov. 3, 1993

[30] Foreign Application Priority Data

Nov. 4, 1992 [SE] Sweden ..... 9203256

[51] Int. Cl.[6] ..... F42C 13/08

[52] U.S. Cl. ..... 102/212

[58] Field of Search ..... 102/211, 212

[56] References Cited

U.S. PATENT DOCUMENTS 3,308,760 3/1967 Peters ..... 102/212
4,123,019 10/1978 Amberntson ..... 244/3.2
4,220,094 9/1980 Nilsson ..... 102/212

FOREIGN PATENT DOCUMENTS 1198165 12/1985 Canada .
2631694 11/1989 France ..... 102/212
7706158 4/1981 Sweden .

*Primary Examiner*—Ian J. Lobo
*Attorney, Agent, or Firm*—Pollock, Vande Sande & Priddy

[57] ABSTRACT

A magnetic proximity fuse for initiating a charge of a moving charge carrier. The proximity fuse includes at least one sensor for sensing a terrestrial magnetic field and producing a signal. At least one sensor senses movement of the charge carrier and produces a signal. A signal processor receives signals from the at least one magnetic field sensor and the at least one movement sensor and produces an output signal to initiate the charge of charge carrier only in response to changes in the terrestrial magnetic field caused by ferromagnetic objects other than the charge carrier or movement of the charge carrier, the output signal initiating the charge of the charge carrier.

13 Claims, 2 Drawing Sheets

MAGNETIC PROXIMITY FUSE

The present invention relates to a magnetic proximity fuse for initiating the charging of a moving charge carrier, for example a guided missile, projectile, grenade or the like, when it passes at a certain distance from a ferromagnetic object.

FIELD OF THE INVENTION

Two types of magnetic proximity fuses are known, active and passive. The one hitherto most used has been the active magnetic proximity fuse. An example of such a proximity fuse is described in Swedish Patent Specification 77.06158-8. The proximity fuse has a transmitter unit with a generator coil which generates an electromagnetic field which is distributed in space in accordance with known laws. The proximity fuse also includes a receiver unit in the form of a sensor coil which is placed separately from the generator coil. When the sensor coil is affected by an electromagnetic field, an electromotive force is induced in the coil. When there is a metal object located in the field from the transmitter unit, eddy currents are induced in its surface. These eddy currents generate a secondary field which is detected by the receiver unit. This makes possible to determine if a metal object is located in the vicinity of the proximity fuse. The range is determined by the output power of the transmitter unit and the sensitivity of the receiver unit. A "typical" range is 0.5–1.5 m. The active magnetic proximity fuse has a distance dependence which monotonically increases from $r^{-3}$ to $r^{-6}$ (r is distance between the proximity fuse and the target).

A passive magnetic proximity fuse utilizes the fact that the terrestrial magnetic field is deformed around ferromagnetic objects, for example large objects of iron, for example military tanks and bodies of iron ore. The proximity fuse includes a sensing system in the form of sensors for flux density, and a signal processing section for evaluating the signals. Due to the fact that changes caused, for example, by a tank in the terrestrial magnetic field are comparable to signals which are obtained in the charge carrier. Moreover, a longer range can be obtained since the distance dependence only increases with $r^{-3}$. At a distance of 3 metres from an iron object of the size of a tank, the effect is of the order of magnitude of 5%, which is sufficient for detection.

In addition to this, demands for systems which do not disclose themselves and for increased resistance to interference provide support for passive systems. Self-disclosure is built into an active system and such a system also detects all well-conducting objects, for example decoys of aluminium foil. A passive system does not disclose itself and requires large ferromagnetic objects in order to provide a signal.

SUMMARY OF THE INVENTION

The object of this invention is to produce a magnetic proximity fuse without an active part, that is a passive magnetic proximity fuse with a greater range than the active proximity fuses known earlier. As already mentioned, the passive magnetic proximity fuse must sense very small changes in the terrestrial magnetic field. Furthermore, the charge carrier's own motion in the terrestrial magnetic field will affect the signal. According to the invention, this problem has been solved in the following manner:

One or more sensors in the form of coils or flux gate sensors sense deviations in the flux density of the terrestrial magnetic field. Furthermore, position-sensing elements, gyros or accelerometers, are arranged on the charge carrier and sense its movements. The sensor signals and, respectively, position signals are supplied to the signal processing, which outputs an active output signal in accordance with a deviation in the terrestrial magnetic field, which signal is compensated for the charge carrier's own motion in the terrestrial magnetic field, so that the active output signal only occurs in dependence on genuine deviations in the terrestrial magnetic field which are occasioned by ferromagnetic objects.

Using a proximity fuse of this type, a greater range is obtained than with an active proximity fuse, and resistance to interference is improved.

In the description which follows, the invention will be described in greater detail in connection with the attached drawings which, by way of example, show an advantageous embodiment of the present invention.

DETAILED DESCRIPTION OF THE PREFERRED EMBODIMENTS

Figure 1:
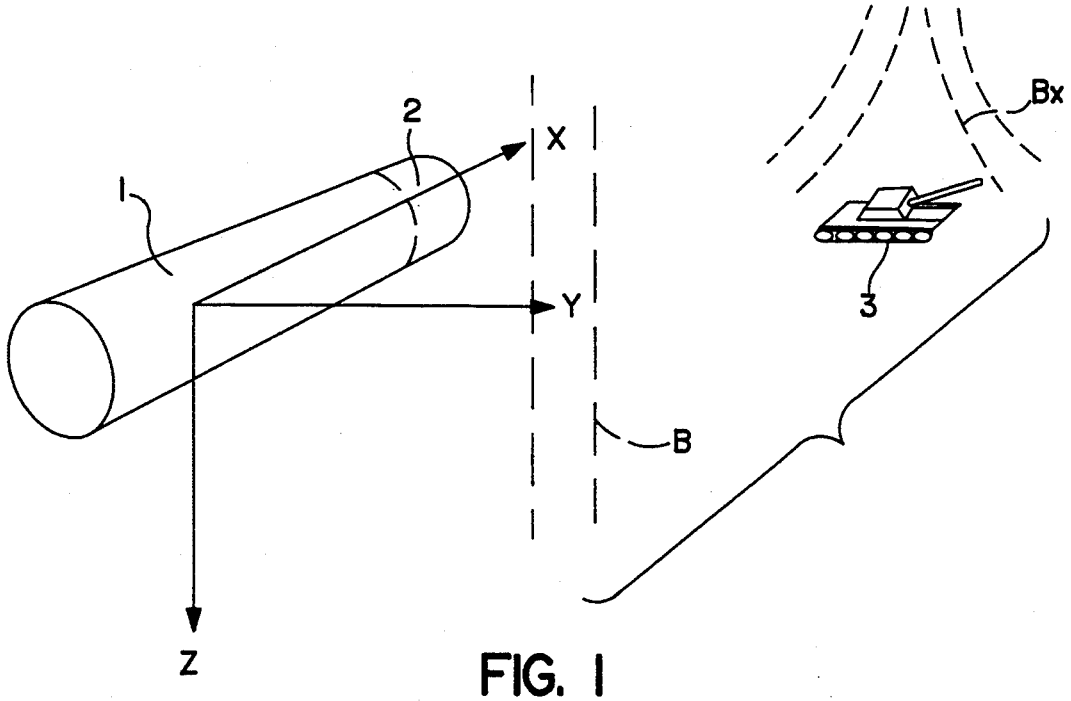
FIG. 1 diagrammatically shows a moving charge carrier (guided missile) which is moving in the terrestrial magnetic field.

FIG. 1 diagrammatically shows a moving charge carrier in the form of a missile 1 which is moving in the terrestrial magnetic field B. The front part of the missile is equipped with a proximity fuse 2 which is to sense the proximity of a ferromagnetic object, for example a tank 3, and then provide an output signal for triggering the warhead part of the missile. The proximity fuse 2 consists of a passive magnetic proximity fuse with sensors for the terrestrial magnetic field B.

To facilitate the continued description, an orthogonal missile-fixed coordinate system with the XYZ axes according to the figure is introduced, that is the X axis coincides with the longitudinal axis of the missile, the Y axis is at right angles to the side and the Z axis is at right angles downwards. The position and movement of the missile can be described with the aid of the roll, pitch and yaw angles $\Phi$, $\theta$ and $\psi$, defined as follows:

The roll angle $\Phi$ specifies a turning around the X axis. The angle is positive with a Y—Z turning, that is clockwise as seen from the back of the missile.

The pitch angle $\theta$ specifies a turning around the Y axis. The angle is positive with a X—Z turning, that is to say missile nose up.

The yaw angle $\psi$ specifies a turning around the Z axis. The angle is positive with an X—Y turning, that is yawing to the right.

For the sake of simplicity, it is assumed that the sensors are made up of three orthogonal sensors, that is the sensors directed in the X, Y and Z directions. The three sensors then sense the flux densities $B_x$, $B_y$ and $B_z$. These flux densities are changed with the movements of the missile in accordance with the following system of equations:

$$dB_x = -d\theta B_z + d\psi B_y$$

$$dB_y = d\psi B_z - d\psi B_x$$

$$dB_z = -d\psi B_y + d\theta B_x$$

Certain sensors, for example flux gate sensors, provide $B_x$, $B_y$ and $B_z$ directly. Other sensors of the coil type provide the time derivative of the B field and $B_x$, $B_y$ and $B_z$ must then be calculated by solving the system of equations.

As mentioned in the introduction, a ferromagnetic object gives rise to deviations in the terrestrial magnetic field. In principle, the disturbance of the terrestrial magnetic field by the target can be represented by a magnetic dipole. The orientation of the dipole depends on the direction of the terrestrial magnetic field. If the terrestrial magnetic field is vertical, the axis of the dipole becomes vertical and if the terrestrial magnetic field is horizontal the axis of the dipole becomes horizontal. The range of the dipole (defined as the distance at which the dipole gives a certain field strength) is longer in the direction of the axis than in the equatorial plane but the difference only amounts to a factor of $3\sqrt{2} = 1.26$.

As also mentioned in the introduction, the missile's own rotational movements in the terrestrial magnetic field give rise to a sensor signal. According to the invention, the proximity fuse includes a signal processor 5 which is arranged to compensate for the missile's own movements in the terrestrial magnetic field so that an active output signal only occurs in response on those deviations in the terrestrial magnetic field which are occasioned by a ferromagnetic object (the target). The missile therefore includes position-sensing elements 6, for example gyros, which sense the movement of the missile and the output signal, the gyro signal, is supplied to the signal processor for evaluation, see FIG. 2.

Figure 2:
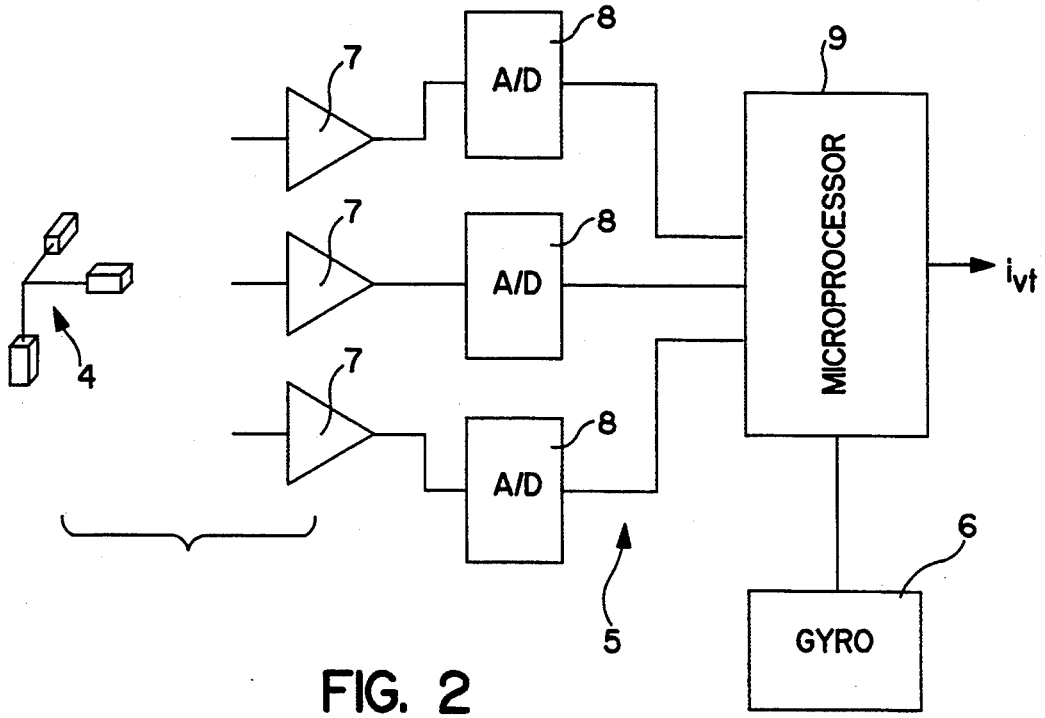
FIG. 2 shows a block diagram of the main parts of the proximity fuse.

FIG. 2 shows a block diagram of the main parts of the proximity fuse. Three sensors 4 measure the magnetic flux densities $B_x$, $B_y$ and $B_z$. The sensor signals are supplied via amplifiers 7 and A/D convertors 8 to the signal processor in the form of a microprocessor 9 for evaluation. The microprocessor is also supplied with gyro signals from the gyro 6 which senses the missile's own motion.

The proximity fuse is intended to operate as follows:

On launching, the three components in the terrestrial magnetic field B are measured. From these values, the magnitude and direction of the terrestrial magnetic field are calculated.

During the continued flying time of the missile, the magnitude of the magnetic field $B_x$, $B_y$ and $B_z$ is continuously measured and compared with the original values. If a deviation occurs, that is a change in the magnetic field which cannot be explained by a motion of the missile, there must be a ferromagnetic object in the vicinity, that is to say the target has been encountered, and the proximity fuse outputs an yields signal to the warhead.

Figure 3:
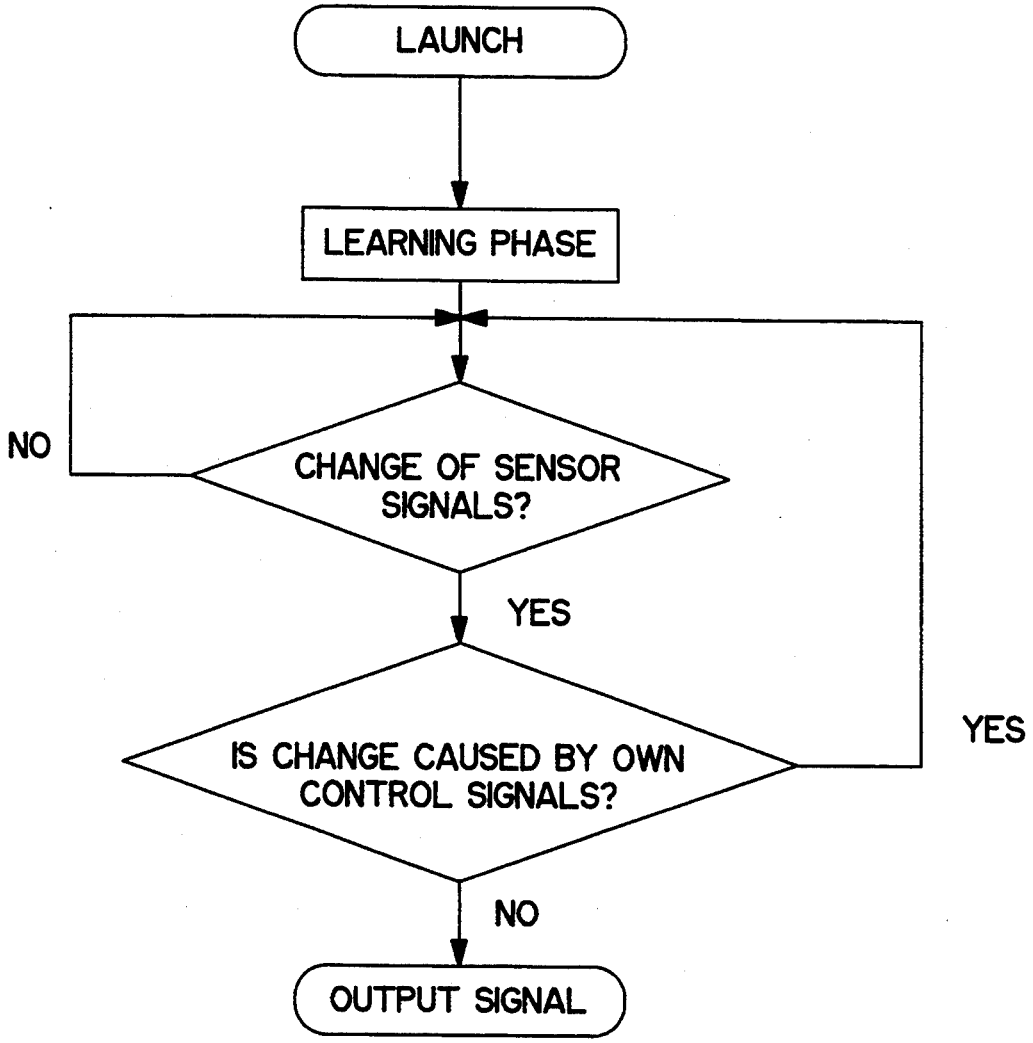
FIG. 3 shows a flow diagram of the signal evaluation.

The functional principle is illustrated in FIG. 3 with the aid of a flow chart.

We claim:

1. A magnetic proximity fuse for initiating a charge of a moving charge carrier, said proximity fuse comprising:

at least one sensor for sensing a terrestrial magnetic field and producing a signal;

at least one sensor for sensing movement of the charge carrier and producing a signal;

a signal processor for receiving signals from the at least one magnetic field sensor and the at least one movement sensor, the signal processor determining which changes sensed in the terrestrial magnetic field result from movement of the charge carrier and producing an output signal to initiate the charge of the charge carrier only in response to changes in the terrestrial magnetic field caused by ferromagnetic objects other than the charge carrier or movement of the charge carrier.

2. A magnetic proximity fuse according to claim 1, further comprising three magnetic field sensors, each one for sensing the magnetic field in a direction orthogonal to the other two.

3. A magnetic proximity fuse according to claim 2, wherein the magnetic field sensors are flux gate sensors for sensing flux densities of the terrestrial magnetic field.

4. A magnetic proximity fuse according to claim 2, wherein magnetic field sensors include coils for sensing a time derivative of flux densities of the terrestrial magnetic field.

5. A magnetic proximity fuse according to claim 2, wherein magnetic field sensors include Hall elements for sensing flux densities of the terrestrial magnetic field.

6. A magnetic proximity fuse according to claim 1, wherein the at least one movement sensor includes a gyro.

7. A magnetic proximity fuse according to claim 1, further comprising a plurality of movement sensors, wherein the movement sensors include gyros for measuring roll, and yaw movements of the charge carrier.

8. A magnetic proximity fuse according to claim 7, further comprising a gyro for measuring pitch movement of the charge carrier.

9. A magnetic proximity fuse according to claim 1, wherein the at least one movement sensor includes an accelerometer.

10. A magnetic proximity fuse according to claim 1, further comprising a plurality of movement sensors, wherein the movement sensors include accelerometers for measuring roll and yaw movements of the charge carrier.

11. A magnetic proximity fuse according to claim 10, further comprising an accelerometer for measuring pitch movement of the charge carrier.

12. A magnetic proximity fuse according to claim 1, wherein the signal processor determines if changes in the terrestrial magnetic field result from movement of the charge carrier by continuously comparing signals produced by the at least one movement sensor during movement of the charge carrier with signals produced by the at least one movement sensor at a time of launching the charge carrier and with a change in magnitude of the signals produced by the movement sensors, wherein if the changes do not result from movements of the charge carrier, the signal processor sends a signal to an effective part of the moving charge carrier to initiate the charge.

13. A magnetic proximity fuse according to claim 1, wherein the signal processor includes a microprocessor for signal processing.

* * * * *